US006696626B1

(12) United States Patent
Pagenkopf

(10) Patent No.: US 6,696,626 B1
(45) Date of Patent: Feb. 24, 2004

(54) CELLO ENDPIN RESTRAINT

(76) Inventor: Jon J. Pagenkopf, 5775 N. Bayridge Ave., Whitefish Bay, WI (US) 53217

( * ) Notice: Subject to any disclaimer, the term of this patent is extended or adjusted under 35 U.S.C. 154(b) by 0 days.

(21) Appl. No.: 10/174,891

(22) Filed: Jun. 19, 2002

(51) Int. Cl.[7] ..... G10D 1/02
(52) U.S. Cl. ..... 84/280; 84/327; 84/421; 84/281
(58) Field of Search ..... 84/280, 327, 421, 84/281; 248/443

(56) References Cited

U.S. PATENT DOCUMENTS

| | | | | |
|---|---|---|---|---|
| 915,345 A | * | 3/1909 | Gould | 84/280 |
| 2,934,131 A | * | 4/1960 | Wenger | 297/186 |
| 4,018,129 A | | 4/1977 | Hollander | |
| 5,003,858 A | * | 4/1991 | Rowell | 84/280 |
| 5,069,102 A | | 12/1991 | Wolf | |
| 5,696,338 A | | 12/1997 | Grissom | |
| 5,817,959 A | | 10/1998 | Kagan | |

FOREIGN PATENT DOCUMENTS

| | | | |
|---|---|---|---|
| GB | 2224386 | * | 5/1990 |

* cited by examiner

*Primary Examiner*—Shih-yung Hsieh
(74) *Attorney, Agent, or Firm*—Andrus, Sceales, Starke & Sawall, LLP

(57) ABSTRACT

An endpin restraint is provided for a stringed musical instrument having an endpin projecting from the bottom thereof for engagement with a floor surface. The restraint includes an endpin holder adapted to receive the endpin of the musical instrument. An anchoring rod is adapted to be positioned behind front legs of a chair upon which a musician is seated to play the musical instrument. An adjustment strap interconnects the endpin holder and the anchoring rod. With this arrangement, the endpin holder prevents the endpin from sliding across the floor surface and causing damage to a free end of the endpin and the floor surface, and stabilizes the endpin so as to hold the musical instrument in a desired position.

13 Claims, 2 Drawing Sheets

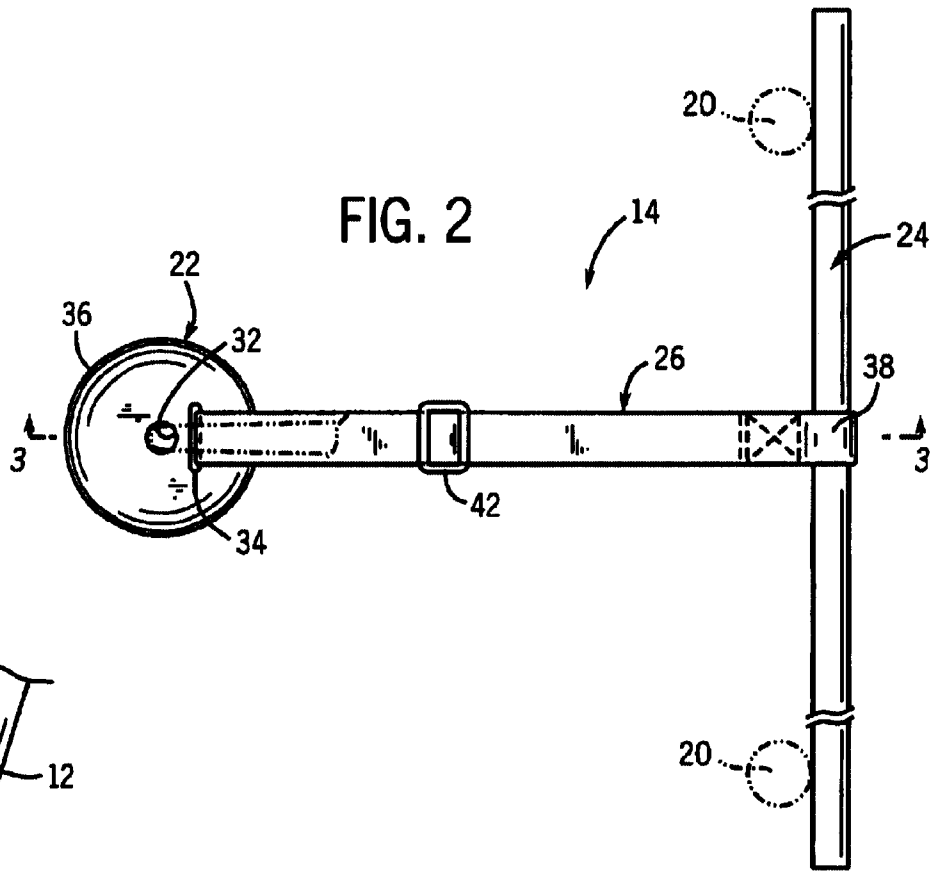
FIG. 2
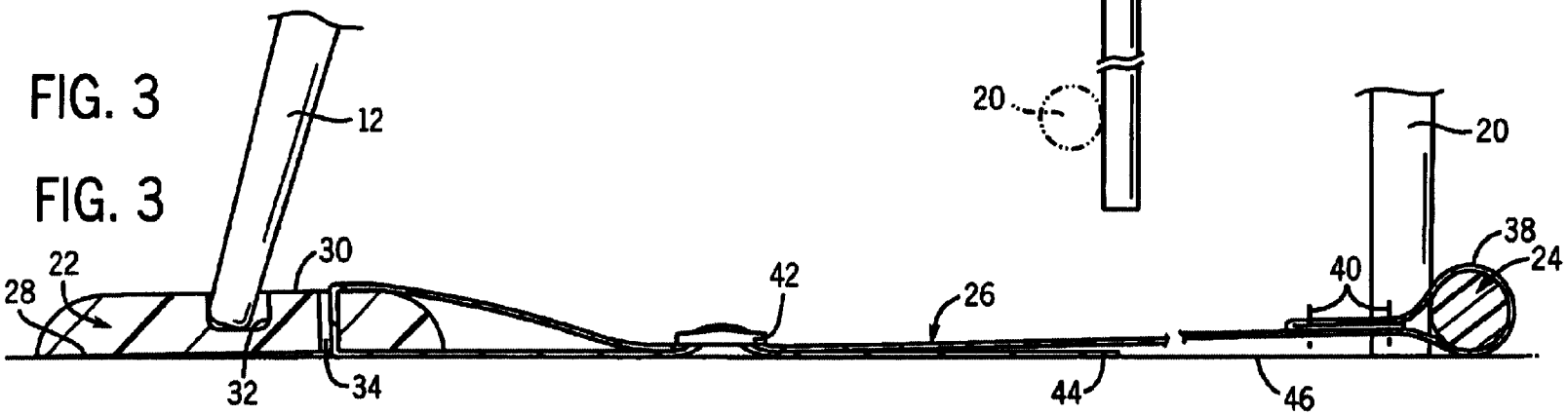
FIG. 3
FIG. 3

CELLO ENDPIN RESTRAINT

FIELD OF THE INVENTION

This invention relates generally to peripheral equipment for stringed musical instruments and, more particularly, pertains to a protective and stabilizing device used in conjunction with the endpin of a floor-based, bowed, stringed instrument such as a cello or bass.

BACKGROUND OF THE INVENTION

A cello is provided at its bottom end surface with a projecting endpin that engages the floor as the cellist is seated upon a chair so that the instrument may be held in a suitable playing position. In order to prevent damage to the floor as a result of direct contact with the free end of the endpin and prevent the leg from sliding along the floor so as not to impair the performance of the cellist, it is known to provide a protective device which engages the floor and receives the endpin.

One such device is disclosed in U.S. Pat. No. 4,018,129 issued Apr. 19, 1997 to Hollander. In this patent, an end-pin holder for stringed instruments includes a back plate raised above the floor by pads or feet of cushioning material, and a top plate supported above the back plate and coupled thereto by a sound post. The top plate is provided with a socket to receive the end-pin.

Another device is set forth in U.S. Pat. No. 5,069,102 issued Dec. 3, 1991 to Wolf. The '102 patent discloses an attachment including a carrier member separably connectable to the endpin, and a supporting member connected to the carrier member for supporting a hemispherical or conical floor contacting, elastomeric material.

A more recent device is shown in U.S. Pat. No. 5,696,338 issued Dec. 9, 1997 to Grissom. The Grissom floor protector has an upper surface having a plurality of raised supports forming pockets therebetween for supporting an endpin of a musical instrument.

Although these prior art devices may have performed satisfactorily for their intended purpose, it is desirable to provide a differently styled endpin and floor protector which is less costly to manufacture, more easily carried when not in use and which will enable the necessary stabilization of the endpin relative to the floor.

SUMMARY OF THE INVENTION

It is a general object of the present invention to provide a floor protector for use with the endpin of a stringed musical instrument, such as a cello or bass, which maintains the integrity of the floor surface and prevents blunting of the endpin.

It is one object of the present invention to provide an endpin restraint for a stringed musical instrument which is easy to connect and disconnect from the endpin and which provides an adjustment feature for establishing the desired position of the instrument.

It is also an object of the present invention to provide an endpin holder having a collapsible nature when not in use which makes it extremely easy to carry within the case of the endpin equipped musical instrument.

It is a further object of the present invention to provide an endpin restraining arrangement having three long-lasting, inexpensively produced components.

It is an additional object of the present invention to provide an endpin restraint which maintains a low profile in use.

In one aspect of the invention, an endpin holder is provided for a stringed musical instrument having an endpin projecting from the bottom surface therefrom and engaging the holder to prevent contact of the endpin with a floor surface as a musician is seated upon a chair holding the musical instrument. The invention is improved by an arrangement for interconnecting the endpin holder with the chair to stabilize the position of the endpin holder.

In another aspect of the invention, an endpin restraint is provided for a stringed instrument having an endpin projecting from the bottom thereof for engagement with a floor surface. The restraint includes a first structure for receiving the endpin of the musical instrument. A second structure is adapted to be engaged with the legs of a chair upon which a musician is seated to play the musical instrument. A third structure is adjustably interconnected between the first structure and the second structure. With this arrangement, the first structure prevents the endpin from contacting and sliding across the floor surface and causing damage to a free end of the endpin and the floor surface, and stabilizes the endpin so as to hold the musical instrument in a desired position. The first structure is preferably a generally rigid endpin holder. The second structure is preferably a generally rigid, elongated anchoring rod. The third structure is preferably a generally flexible, elongated adjustment strap. The endpin holder has a lower surface adapted to engage the floor surface, and an upper surface formed with pocket structure for receiving the endpin and a slot extending through the lower and upper surfaces. The endpin holder has an outer periphery and the slot is located between the pocket and the outer periphery. The anchoring rod has a length which is longer than the length between the legs of the chair. The adjustment strap has one end fixed to the anchoring rod, extends forwardly through an adjustment buckle, passes through the slot formed in the endpin holder, travels rearwardly through the buckle and terminates in a free end. Adjustment of the strap changes the distance between the anchoring rod and the endpin holder.

In a further aspect of the invention, an endpin restraint is provided for a stringed musical instrument having an endpin projecting from the bottom thereof for engagement with a floor surface. The restraint includes an endpin holder adapted to receive the endpin of the musical instrument. An anchoring rod is adapted to be positioned behind front legs of a chair upon which a musician is seated to play the musical instrument. An adjustment strap interconnects the endpin holder and the anchoring rod. With this arrangement, the endpin holder prevents the endpin from sliding across the floor surface and causing damage to a free end of a end pin and the floor surface, and stabilizes the end pin so as to hold the musical instrument in a desired position.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 2 is a plan view of the endpin restraint shown in FIG. 1; and

FIG. 3 is a sectional view taken on line 3—3 of FIG. 2 showing an endpin received in the restraint.

DETAILED DESCRIPTION OF THE INVENTION

Figure 1:
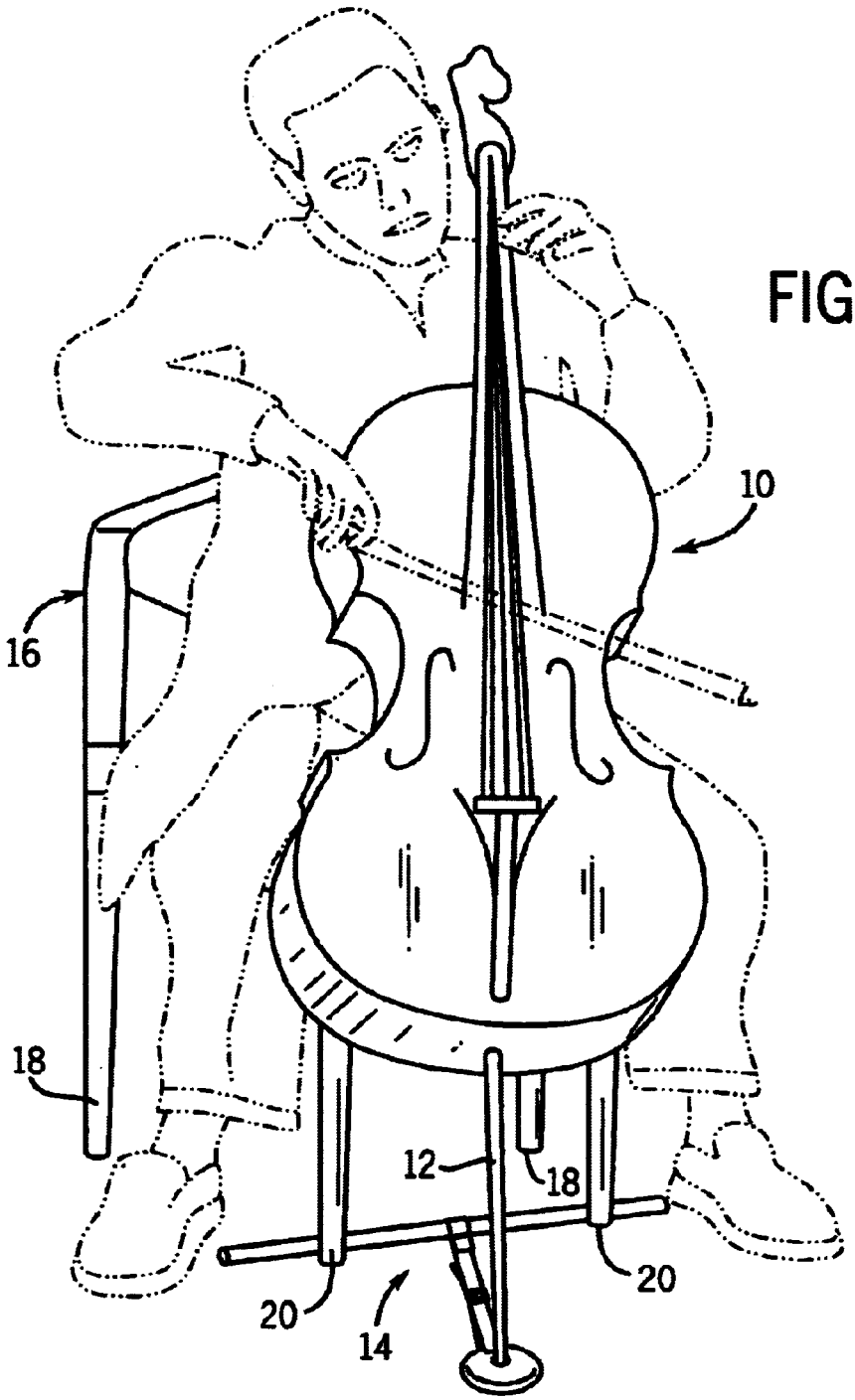
FIG. 1 is a perspective view of a cello having an endpin held by a restraint in accordance with the invention.

Referring now the drawings, FIG. 1 shows a conventional large bowed, stringed instrument, preferably in the form of a cello 10, having an endpin 12 projecting from the bottom end thereof, the endpin 10 being captively and removably received in a restraint 14 in accordance with the invention. A cellist (shown in phantom lines), plays the instrument in a position slightly angled from vertical while normally seated in a chair 16 having a pair of rear legs 18 and a pair of front legs 20.

Referring to FIGS. 2 and 3, the restraint 14 is comprised of an endpin holder 22, an anchoring rod 24 and an adjustment strap 26 interconnecting the holder 22 with the rod 24.

The endpin holder 22 is shown as having a circular configuration with a flat lower surface 28 and an upper surface 30 curving downwardly to the lower surface 28. Upper surface 30 is formed with a central pocket 32 for receiving the free end of the endpin 12. If desired, the endpin holder 22 could be formed with more than one pocket 32. A linear slot 34 is formed through the thickness of the endpin holder 22 at a point generally midway between the central pocket 32 and a periphery 36 of the endpin holder 22. As will be appreciated hereafter, the slot 34 is oriented rearwardly of central pocket 32 and is oriented substantially parallel to a line interconnecting the front legs 20 of chair 16 and is spaced a distance therefrom.

The anchoring rod 24 is a rigid, elongated cylindrical element having a length which is generally longer than the length between the front legs 20 of the chair 16. The rod 24 is intended to be positioned behind the front legs 20 with its end portions lodged behind the rear surfaces of the front legs 20.

The adjustment strap 26 is a flexible, elongated band extending between the endpin holder 22 and the anchoring rod 24. The strap 24 has one end 38 which is wrapped around the middle of the anchoring rod 24, folded over itself and then stitched together at 40. From the end 38, strap 26 extends forwardly where it is threaded through an adjustment buckle 42, proceeds through the slot 34 in the endpin holder 22, travels rearwardly for further threading through buckle 42 and terminates in a second or free end 44. It should be understood that pulling or pushing on the second end 44 while holding the buckle 42 will adjust the length of the strap 26 between the endpin holder and the anchoring rod 24.

The endpin holder 22 is typically fabricated from rigid plastic or hard rubber, the anchoring rod 24 typically is constructed of rigid plastic and the adjustment strap 26 is typically made of cloth or plastic. Other suitable materials may, of course, be used.

The three-part interconnected restraint 14 is generally conveniently stored in a collapsed condition in the case of the cello 10. When it is desired to use the restraint 14, the anchoring rod 24 is positioned behind the front legs 20 of the cellist's chair 16. With the adjustment strap 26 extending forwardly, the cellist places the attached endpin holder 22 with its lower surface 28 flush upon the floor 46. The cellist then places the free end of the endpin 12 in the central pocket 32 of the holder 22, and slightly tilts the cello 10 rearwardly to the desired playing position. As mentioned above, the strap 26 is adjustable as necessary to position the endpin holder 22 as desired for the individual musician or musical instrument.

The present invention thus provides an endpin restraint 14 which prevents the free end of the endpin 12 from continuous sliding on the floor 46 and causing damage thereto. At the same time, the endpin holder 22 allows movement of the free end of the endpin 12 in the central pocket 32 without damage to the end pin 12. In addition, the restrain 14 serves to stabilize the endpin 12 such that the cello 10 will not slip or jump away from the cellist. Preventing the sudden unexpected movement of the cello aids the cellist in maintaining his/her concentration and safeguards against a faulty musical passage. The restraint 14 is generally set in place in a few seconds and provides a low profile which is hardly noticeable to those in an audience. Because of the composition of the components, the cost of producing the restraint 14 is low and the cost of maintenance is minimal. Unlike many of the prior art endpin protectors, the restraint 14 is particularly easy to store in a cello case because of its collapsibility.

It should be understood that the endpin holder 22 may have other configurations other than circular. Likewise, the anchoring rod 24 may also be configured other than in cylindrical form. The restraint 14 is intended for use with other musical instruments having an endpin engageable with a floor structure.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

I claim:

1. An endpin restraint for a stringed musical instrument having an endpin projecting from the bottom thereof for engagement with a floor surface, the restraint comprising:

a generally rigid endpin holder for receiving the endpin of the musical instrument, wherein the endpin holder has a lower surface adapted to engage the floor surface, and an upper surface formed with pocket structure for receiving the endpin and a slot extending through the lower and upper surfaces;

a second structure adapted to be engaged with the legs of a chair upon which a musician is seated to play the musical instrument; and a third structure adjustably interconnecting the endpin holder and the second structure, wherein the endpin holder prevents the endpin from contacting and sliding across the floor surface and causing damage to a free end of the endpin and the floor surface, and stabilizes the endpin so as to hold the musical instrument in a desired position.

2. The endpin restraint of claim 1, wherein the second structure is a generally rigid, elongated anchoring rod.

3. The endpin restraint of claim 2, wherein the anchoring rod has a length which is longer than the length between the legs of the chair.

4. The endpin restraint of claim 1, wherein the third structure is a generally flexible, elongated adjustment strap.

5. The endpin restraint of claim 4, wherein the adjustment strap has one end fixed to the anchoring rod, extends forwardly through an adjustment buckle, passes through the slot formed in the endpin holder, travels rearwardly through the buckle and terminates in a free end.

6. The endpin restraint of claim 5, wherein adjustment of the strap changes the distance between the anchoring rod and the endpin holder.

7. The endpin restraint of claim 1, wherein the endpin holder has an outer periphery and the slot is located between the pocket and the outer periphery.

8. An endpin restraint for a stringed musical instrument having an endpin projecting from the bottom thereof for engagement with a floor surface, the restraint comprising:

an endpin holder adapted to receive the endpin of the musical instrument, wherein the endpin holder has a lower surface adapted to engage the floor surface, and an upper surface formed with a pocket structure for receiving the endpin and a slot extending through the lower and upper surfaces;

an anchoring rod adapted to be positioned behind front legs of a chair upon which a musician is seated to play the musical instrument; and an adjustment strap interconnecting the endpin holder and the anchoring rod, wherein the endpin holder prevents the end pin from sliding across the floor surface and causing damage to a free end of the endpin and the floor surface, and stabilizes the endpin so as to hold the musical instrument in a desired position.

9. The endpin restraint of claim 8, wherein the endpin holder has an outer periphery and the slot is located between the pocket and the outer periphery.

10. The endpin restraint of claim 8, wherein the anchoring rod has a length which is longer than the length between the front legs of the chair.

11. The endpin restraint of claim 8, wherein the anchoring rod is comprised of a rigid material.

12. The endpin restraint of claim 8, wherein the adjustment strap has one end fixed to the anchoring rod, extends forwardly through an adjustment buckle, passes through the slot formed in the endpin holder, travels rearwardly through the buckle and terminates in the free end.

13. The endpin restraint of claim 12, wherein an adjustment of the strap changes the distance between the anchoring rod and the endpin holder.

* * * * *